US012753539B2

(12) United States Patent
Whittle

(10) Patent No.: US 12,753,539 B2
(45) Date of Patent: Oct. 6, 2026

(54) WASHING MACHINE SUBWASHER GROUND DETECTION

(71) Applicant: Haier US Appliance Solutions, Inc., Wilmington, DE (US)

(72) Inventor: Joshua Whittle, Georgetown, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 126 days.

(21) Appl. No.: 18/638,244

(22) Filed: Apr. 17, 2024

(65) Prior Publication Data

US 2025/0327231 A1 Oct. 23, 2025

(51) Int. Cl.
*D06F 33/50* (2020.01)
*D06F 34/14* (2020.01)

(52) U.S. Cl.
CPC ..... *D06F 33/50* (2020.02); *D06F 34/14* (2020.02)

(58) Field of Classification Search
CPC ..... D06F 33/30; D06F 33/04; D06F 33/50; D06F 33/74; D06F 34/00; D06F 34/04; D06F 34/10; D06F 34/14; D06F 2103/00; D06F 2103/44; D06F 2105/58; D06F 2105/60; D06F 2105/62; G01R 31/50; G01R 31/52; G01R 31/58; H02H 5/105
See application file for complete search history.

(56) References Cited

U.S. PATENT DOCUMENTS

| | | | | |
|---|---|---|---|---|
| 10,359,884 | B2 | 7/2019 | Hotelling et al. | |
| 11,655,582 | B2 | 5/2023 | Christensen et al. | |
| 2002/0121902 | A1* | 9/2002 | Suzuki | B60L 3/0069 324/509 |
| 2004/0006831 | A1* | 1/2004 | Kim | D06F 34/18 68/12.04 |
| 2013/0175248 | A1* | 7/2013 | De Rosa | B23K 9/0956 219/130.01 |

FOREIGN PATENT DOCUMENTS

| | | | |
|---|---|---|---|
| CA | 2412296 | A1 | 5/2004 |
| CN | 101407987 | B | 8/2010 |
| CN | 106887775 | A | 6/2017 |
| CN | 206533139 | U | 9/2017 |
| CN | 114113848 | A | 3/2022 |
| DE | 10104682 | B4 | 9/2004 |
| FR | 2347727 | A1 | 11/1977 |

OTHER PUBLICATIONS

Machine Translation of Wu et al., CN 114113848, Mar. 2022. (Year: 2022).*

* cited by examiner

*Primary Examiner* — David G Cormier
(74) *Attorney, Agent, or Firm* — Dority & Manning, P.A.

(57) ABSTRACT

A control circuit for a washing machine appliance is provided. The control circuit includes a ground detection circuit configured to receive a test signal from a test ground path. The control circuit further includes a controller configured to determine a grounding state of a subwasher of the washing machine appliance based at least in part on the test signal. The test ground path operatively couples the ground detection circuit to the subwasher.

20 Claims, 6 Drawing Sheets

WASHING MACHINE SUBWASHER GROUND DETECTION

FIELD

Example aspects of the present disclosure relate generally to washing machine appliances, and more specifically to ground detection in a subwasher of a washing machine.

BACKGROUND

Washing machine appliances generally include a cabinet configured to receive a tub for containing wash fluid and a wash basket rotatably mounted within the wash tub. A drive assembly is coupled to the wash tub and configured to rotate the wash basket within the wash tub agitate a load of laundry articles (i.e. clothes) within the wash basket. Often, the tub, wash basket, and drive assembly, taken together as one unit, are referred to as a subwasher.

SUMMARY

Aspects and advantages of embodiments of the present disclosure will be set forth in part in the following description, or can be learned from the description, or can be learned through practice of the embodiments.

One example aspect of the present disclosure is directed to a control circuit for a washing machine appliance. The control circuit includes a ground detection circuit configured to receive a test signal from a test ground path. The control circuit further includes a controller configured to determine a grounding state of a subwasher of the washing machine appliance based at least in part on the test signal. The test ground path operatively couples the ground detection circuit to the subwasher.

Another example aspect of the present disclosure is directed to a method for determining a grounding state of a subwasher in a washing machine appliance. The method includes receiving, by a ground detection circuit of a control circuit, a test signal from a test ground path. The method further includes determining, by a controller of the control circuit, the grounding state based at least in part on the test signal. The test ground path operatively couples the ground detection circuit to the subwasher.

Another example aspect of the present disclosure is directed to a washing machine appliance. The washing machine appliance includes a subwasher. The washing machine appliance further includes a control circuit. The control circuit includes a ground detection circuit configured to receive a test signal from a test ground path. The control circuit further includes a controller configured to determine a grounding state of a subwasher of the washing machine appliance based at least in part on the test signal. The test ground path operatively couples the ground detection circuit to the subwasher.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

Figure 1:
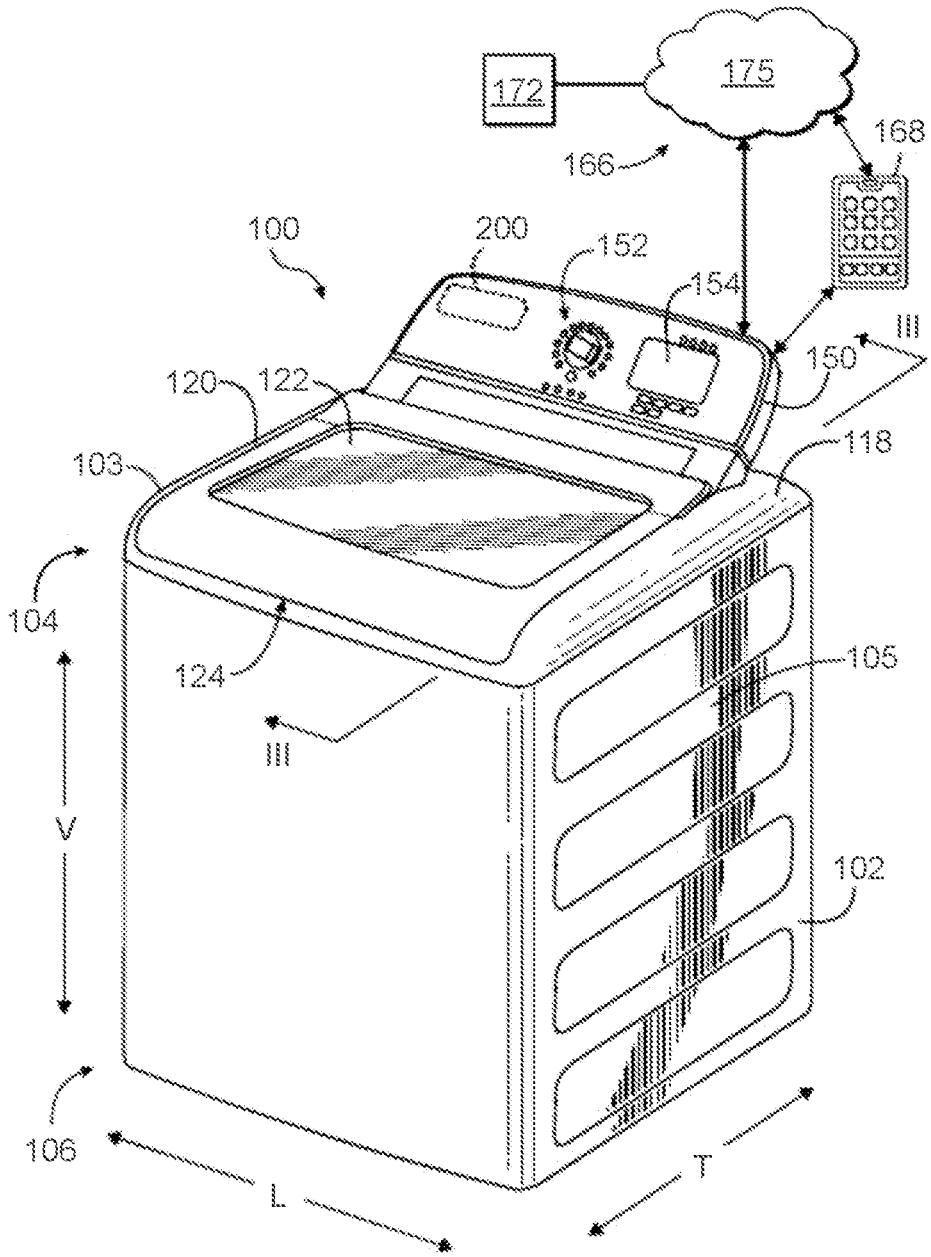
FIG. 1 illustrates a perspective view of a washing machine appliance according to example embodiments of the present disclosure.

Repeat use of reference characters in the present specification and drawings is intended to represent the same and/or analogous features or elements of the present invention.

DETAILED DESCRIPTION

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Some washing machine appliances include a subwasher suspended within the appliance cabinet. In some instances, the subwasher may not be properly grounded. This can cause the washing machine to fail and create unsafe operating conditions for a user. As such, proper grounding of the subwasher may be important for operation of the appliance and safety of users. The grounding state of the subwasher may be determined by manually probing the subwasher. This is problematic and time consuming as the subwasher may be difficult to contact. Alternatively, external hardware such as diagnostics equipment may be connected to the appliance via, for example, a data port to determine the grounding state of the subwasher. However, the positioning of the data port and/or the ground line connecting the data port to the subwasher may cause robustness problems with electrical surge events and requires the use of additional hardware (e.g., diagnostics equipment).

Accordingly, example aspects of the present disclosure are directed to a control circuit for a washing machine appliance. The control circuit includes a ground detection circuit configured to receive a test signal from a test ground path. The control circuit further includes a controller configured to determine a grounding state of a subwasher of the washing machine appliance based at least in part on the test signal. The test ground path operatively couples the ground detection circuit to the subwasher.

Example aspects of the present disclosure provide many technical effects and benefits. For example, aspects of the present disclosure may provide more reliable ground detection of the subwasher and more efficient manufacturing by eliminating the need for additional processes such as manual probing of the subwasher. In addition, positioning the ground detection circuit on the control circuit of the washing machine appliance may decrease the susceptibility of the ground detection circuit to electrical surge events and provides a robust connection to the subwasher.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (e.g., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "coupled," "fixed," "attached to," and the like refer to both direct coupling, fixing, or attaching, as well as indirect coupling, fixing, or attaching through one or more intermediate components or features, unless otherwise specified herein.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Figure 2:
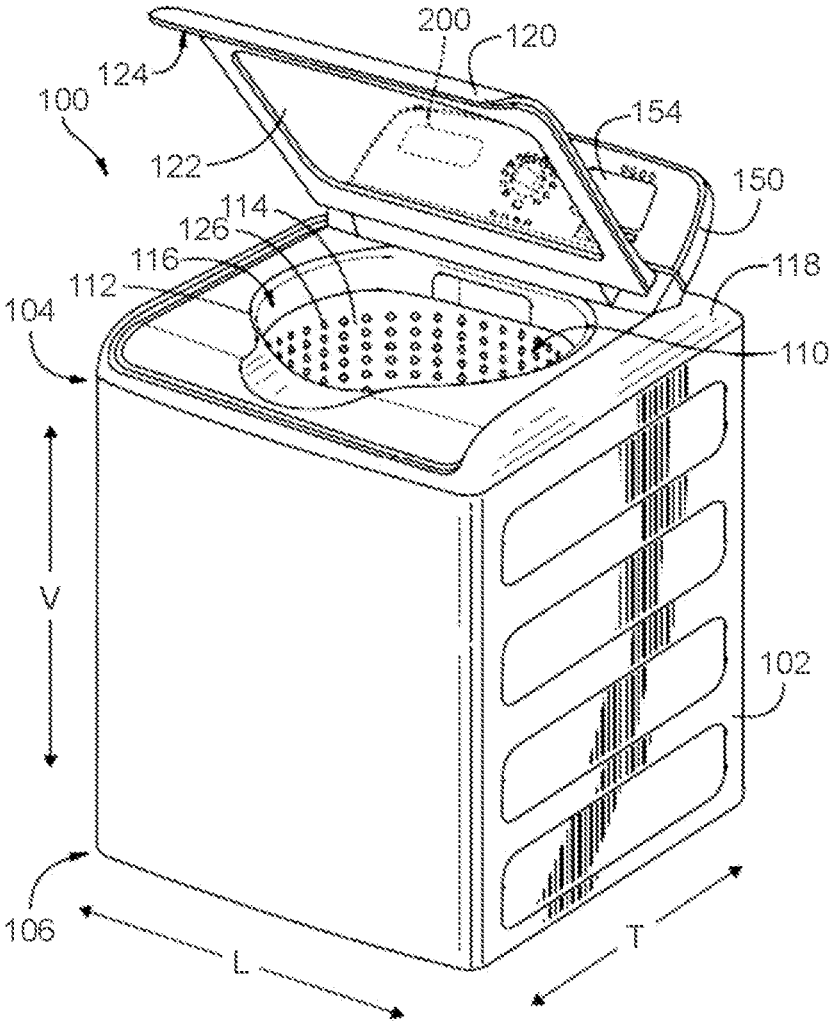
FIG. 2 illustrates another perspective view of a washing machine appliance according to example embodiments of the present disclosure.
Figure 3:
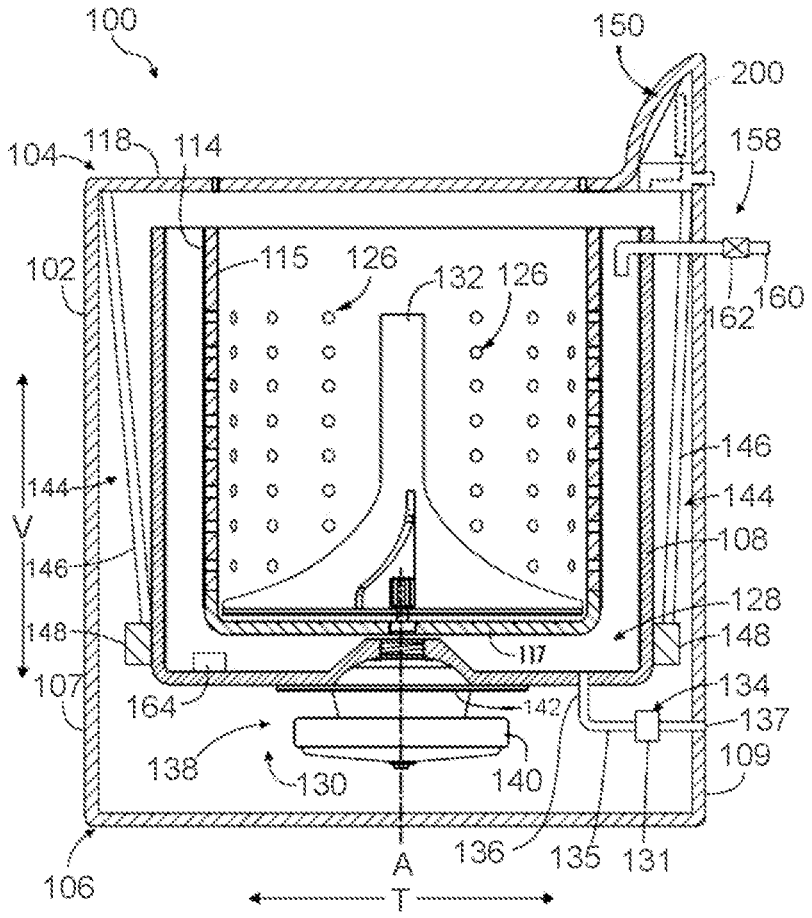
FIG. 3 illustrates a cross-sectional view of a washing machine appliance according to example embodiments of the present disclosure.

Referring now to the figures, FIGS. 1 through 3 illustrate an example embodiment of washing machine appliance 100. Specifically, FIGS. 1 and 2 illustrate perspective views of washing machine appliance 100 with the lid in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

As shown in FIGS. 1 through 3, washing machine appliance 100 is depicted with an axis of rotation A that is substantially parallel to the vertical direction V. In this regard, washing machine appliance 100 is generally referred to as a "vertical axis" or top loading washing machine appliance 100. However, it will be understood that aspects of the present disclosure may be used within the context of any suitable washing machine appliance, such as a horizontal axis or front loading washing machine appliance. Furthermore, one of ordinary skill in the art will understand that modifications and variations may be made to washing machine appliance 100 (e.g., vertical axis washing machine appliance 100), including different configurations, different appearances, or different features while remaining within the scope of the present disclosure.

As shown in FIG. 1, washing machine appliance 100 includes a cabinet 102 that extends between a top portion 104 and a bottom portion 106 along the vertical direction V, between a first (left) side panel 103 and a second (right) side panel 105 along the lateral direction L, and between a front panel 107 and a rear panel 109 along the transverse direction T. As shown in FIG. 3, a wash tub 108 is positioned within cabinet 102, the wash tub 108 defining a wash chamber 110, and generally configured for retaining wash fluids during an operating cycle. As used herein, "wash fluid" means water, or water with additives (for example detergent, fabric softener, or bleach) used in any part of a laundry appliance operation or cycle. Without limitation, "wash fluid" includes fluid used in wash, rinse, or drain and spin cycles.

Further, washing machine appliance 100 includes a wash basket 114 positioned within wash tub 108 and generally defining an opening 116 for receipt of laundry articles for washing. Wash basket 114 is defined by a side wall 115 and a bottom wall 117 with side wall 115 and bottom wall 117 defining a wash chamber 110. Wash basket 114 is supported within wash tub 108 for rotation about an axis of rotation A. According to the illustrated embodiment, the axis of rotation A is substantially parallel to the vertical direction V and runs through the center of the wash tub 108 and wash basket 114. In this regard, washing machine appliance 100 is generally referred to as a "vertical axis" or top loading washing machine appliance 100.

As illustrated, cabinet 102 of washing machine appliance 100 has a top panel 118 which defines a top panel opening 112 (FIG. 2) that coincides with opening 116 of wash basket 114 to permit a user access to wash basket 114. Washing machine appliance 100 further includes a lid 120 which may be rotatably mounted to top panel 118 to permit selective access to wash basket 114 through opening 116. Lid 120 selectively rotates between the closed position (FIG. 1) and the open position (FIG. 2). In the closed position, lid 120 blocks access to wash basket 114. Conversely, in the open position, a user can access wash basket 114. A window 122 in lid 120 permits viewing of wash basket 114 when lid 120 is in the closed position, for example, during operation of washing machine appliance 100. Lid 120 may also include a handle 124 that may facilitate opening and closing lid 120. Further, although lid 120 is illustrated as mounted to top panel 118, lid 120 may alternatively be mounted to cabinet 102 or any other suitable support.

As illustrated in FIGS. 2 and 3, wash basket 114 may further define a plurality of perforations 126 formed in side wall 115 to facilitate fluid communication between an interior of wash basket 114 and wash tub 108. For at least this purpose, wash basket 114 is spaced apart from wash tub 108 to define a space for wash fluid to escape wash chamber 110. During a spin cycle, wash fluid within articles of clothing and within wash chamber 110 may be urged through perforations 126 and may collect in a sump 128 defined between the lower portions of wash basket 114 and wash tub 108. Washing machine appliance 100 may further include a pump assembly 134 (FIG. 3) that is located beneath wash tub 108 and wash basket 114 for gravity assisted flow when draining wash tub 108. Pump assembly may include a drain pump 131 and associated conduit or tubing 135 to couple the drain pump 13 to the wash tub 108 and to the external environment 10, for example an external drain (not shown). The first end 136 of tubing 135 may fluidly couple pump assembly 134 to the wash tub 108, for example at sump 128, to facilitate removal of wash fluid. Second end 137 of tubing 135 may be fluidly coupled to an external drain (not shown) to accept effluent from the wash tub 108. Drain pump 131 may be operably coupled to control circuit 200 to accept operating instructions (for example on or off commands or speed control) to drain wash fluid from wash tub 108 and provide feedback to the control circuit 200.

In some embodiments, an impeller or agitation element 132 (FIG. 3), such as a vane agitator, may be disposed in wash basket 114 to impart an oscillatory motion to laundry articles and liquid in wash basket 114. More specifically, agitation element 132 extends into wash basket 114 and assists agitation of articles disposed within wash basket 114 during operation of washing machine appliance 100 to, for example, facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A, which is substantially parallel to vertical direction V and centrally located in wash tub 108.

As illustrated in FIG. 3, washing machine appliance 100 includes a motor assembly 138 in mechanical communication with (i.e., mechanically coupled to) wash basket 114 and agitation element 132 (if present) to selectively rotate wash basket 114, for example during an agitation or a rinse cycle of washing machine appliance 100. In addition, motor assembly 138 may also be in mechanical communication with agitation element 132. In this manner, motor assembly 138 may be configured for selectively rotating or oscillating wash basket 114 and/or agitation element 132 during various operating cycles of washing machine appliance 100.

Motor assembly 138 may generally include one or more of a drive motor 140 and a transmission assembly 142, for example a clutch assembly for engaging and disengaging wash basket 114 and/or agitation element 132 with the drive motor 140. The drive motor 140 may be a brushless DC electric motor, e.g., a pancake motor as illustrated. However, according to alternative embodiments, drive motor 140 may be any other suitable type or configuration of motor. For example, drive motor 140 may be an AC motor, an induction motor, a permanent magnet synchronous motor, or any other suitable type of motor. In addition, motor assembly 138 may include any other suitable number, types, and configurations of support bearings or drive mechanisms. Generally, the motor assembly 138 is fixed to the wash tub 108 with appropriate sealing elements (not shown) to achieve a watertight seal to contain wash fluid in the wash tub 108.

The components of washing machine appliance 100 suspended from cabinet 102 may be collectively defined as a subwasher 130 of washing machine appliance 100. For example, subwasher 130 may include the wash tub 108, the wash basket 114, and the motor assembly 138.

The subwasher 130 may be suspended from the cabinet 102 and supported by a vibration damping suspension system. The damping suspension system operates to damp dynamic motion as the wash basket 114 rotates within the tub 108, for example during a spin cycle. The damping suspension system can include one or more suspension assemblies 144 coupled between and to the cabinet 102 and subwasher 130. Generally, the suspension assemblies 144 comprise a suspension rod 146 and a spring damper 148. Typically, four suspension assemblies 144 are utilized, and are spaced apart about the subwasher 130. In the illustrative example of FIG. 3, four suspension assemblies 144 are provided, two are visible in the figure and two are hidden by the visible suspension assemblies 144.

The suspension assemblies 144 may be distributed around the subwasher 130 in any suitable manner to provide support and motion damping to the subwasher 130. For example, each suspension assembly 144 may be rotatably attached at one end proximate a corner of the cabinet 102. At an opposite end, the suspension assembly 144 may be rotatably attached to the subwasher 130 as illustrated. In other embodiments, the suspension assemblies 144 may be rotatably attached to the cabinet 102 and subwasher 130 in other locations. In the example embodiment of FIG. 3, the spring damper 148 is disposed between the subwasher 130 and the suspension rod 146. In other embodiments, the spring damper 148 may be disposed between the cabinet 102 and the suspension rod 146. In still other embodiments, the spring damper 148 may be disposed in other locations along the length of the suspension rod 146.

Referring still to FIGS. 1 through 3, washing machine appliance 100 further includes a control panel 150. As shown, control panel 150 may extend from top panel 118 of washing machine appliance 100. Control panel 150 may include one or more input selector 152 (e.g., a user interface input) for operator selection of machine cycles and features. A display 154 of control panel 150 may indicate selected features, operation mode, a countdown timer, and/or other items of interest to appliance users regarding operation.

Control panel 150 further includes control circuit 200. Operation of washing machine appliance 100 is controlled by control circuit 200 that is operatively coupled (e.g., electrically coupled or connected) to at least one user input selector 152 located on control panel 150 (FIG. 1) for user manipulation to select washing machine cycles and features. Control panel 150 and input selector 152 collectively form a user interface input for operator selection of machine cycles and features. In response to user manipulation of the user input selector 152, control circuit 200 operates the various components of washing machine appliance 100 to execute selected machine cycles and features. A display 154 on control panel 150 may indicate selected features, operation mode, a countdown timer, and/or other items of interest to appliance users regarding operation. In addition to the visual display 154, control panel 150 may also include auditory signaling devices, such as a speaker.

Washing machine appliance 100 may receive power from a power supply, such as an residential power outlet or other power source. For example, the power supply may provide may provide conventional 60 Hz, 120-volt or 240-volt AC to washing machine appliance 100. The power supply may also include an earth ground path operatively coupling the power supply to earth ground. As such, washing machine appliance 100 includes an earth ground input configured to operatively connect to earth ground (e.g., via the earth ground path of the power supply). In some embodiments, control panel 150 may include the earth ground input. In such an embodiment, control circuit 200 may be operatively coupled to the earth ground input.

The control circuit 200 may be operably coupled to a wash fluid supply assembly 158 to supply wash fluid to the wash tub 108. Wash fluid supply assembly may include a water supply 160, for example from a municipal water source, a valve 162, and associated piping. The valve 162 may be operably coupled to the control circuit 200 to open and close as needed to supply wash water to the wash tub 108. The wash fluid supply assembly 158 may also be fluidly coupled to dispensers (not shown) for detergent, bleach, or other water treatments that may be combined with the supplied water to produce a wash fluid. The dispensers maty be operably coupled to the control circuit 200 to selectively introduce water treatments to the water in producing wash fluid.

A sensor 164, for example a pressure sensor, may be provided in the wash tub 108 to sense the amount of wash fluid present in the tub 108. The sensor may be operably coupled to the control circuit 200 and send a signal corresponding to the pressure of the water within the tub 108. Accordingly, sensor 164 may be located at or close to the bottom of tub 108. The pressure signal may be converted to a wash fluid depth at the sensor 164 and transmitted to the control circuit 200 or it may be sent to the control circuit 200 for processing and converting into a wash fluid depth. Determining the depth of wash fluid may be useful in determining when the wash basket 114 has received a sufficient amount (or total amount) of wash fluid to properly process a laundry load. Determining the wash fluid depth may also be useful in operating the washing machine appliance 100 during various cycles, such as during a spin cycle. To maintain a proper amount of wash fluid in wash tub 108, the control circuit 200 may selectively operate the drain pump 131 to an on or an off condition in response to a sensor signal from the sensor 164.

Components of washing machine appliance 100 may be in operative communication with control circuit 200 via one or more signal lines or shared communication busses to provide signals to and/or receive signals from the control circuit 200. For example, the control circuit 200 may communicate with the motor assembly 138 to selectively rotate the wash basket 114 at various speeds or directions of rotation.

In some embodiments, washing machine appliance 100 may include an external communication system 166. Referring back to FIG. 1, a schematic illustration of an external communication system 166 will be described according to an example embodiment of the present subject matter. In general, external communication system 166 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 166 may be used to transfer data or other information to improve performance of one or more external devices or appliances and/or improve user interaction with such devices.

For example, external communication system 166 permits control circuit 200 of washing machine appliance 100 to communicate with a separate device external to washing machine appliance 100, referred to generally herein as an external device 168. As described in more detail below, these communications may be facilitated using a wired or wireless connection, such as via a network 175. In general, external device 168 may be any suitable device separate from washing machine appliance 100 that is configured to provide and/or receive communications, information, data, or commands from a user. In this regard, external device 168 may be, for example, a personal phone, a smartphone, a tablet, a laptop or personal computer, a wearable device, a smart home system, or another mobile or remote device.

In addition, a remote server 172 may be in communication with washing machine appliance 100 and/or external device 168 through network 175. In this regard, for example, remote server 172 may be a cloud-based server, and is thus located at a distant location, such as in a separate state, country, etc. According to an example embodiment, external device 168 may communicate with a remote server 172 over network 175, such as the Internet, to transmit/receive data or information, provide user inputs, receive user notifications or instructions, interact with or control washing machine appliance 100, etc. In addition, external device 168 and remote server 172 may communicate with washing machine appliance 100 to communicate similar information.

In general, communication between washing machine appliance 100, external device 168, remote server 172, and/or other user devices or appliances may be carried using any type of wired or wireless connection and using any suitable type of communication network, non-limiting examples of which are provided below. For example, external device 168 may be in direct or indirect communication with washing machine appliance 100 through any suitable wired or wireless communication connections or interfaces, such as network 175. For example, network 175 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 166 is described herein according to an example embodiment of the present subject matter. However, it should be appreciated that the example functions and configurations of external communication system 166 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Figure 4:
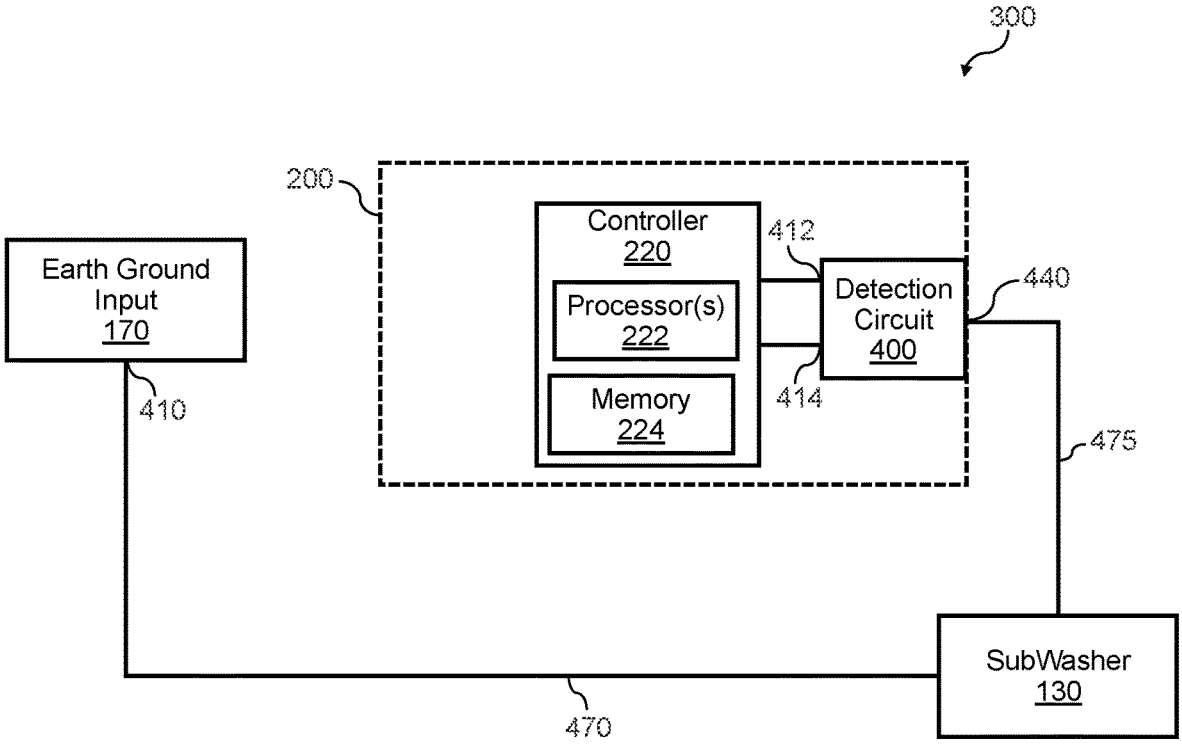
FIG. 4 depicts a block diagram of an example subwasher grounding circuit for a washing machine appliance according to example embodiments of the present disclosure.

FIG. 4 depicts a block diagram of an example subwasher grounding circuit 300 for a washing machine appliance according to example embodiments of the present disclosure. While subwasher grounding circuit 300 is described with reference to washing machine appliance 100 of FIGS. 1-3, those of ordinary skill in the art will understand that subwasher grounding circuit 300 may be implemented in any suitable washing machine appliance.

As shown in FIG. 4, subwasher grounding circuit 300 is configured to ground subwasher 130 of washing machine appliance 100 (FIG. 1). Subwasher 130 may be configured to be grounded by main grounding path 470. As shown, main grounding path 470 is configured to electrically couple subwasher 130 to earth ground input 170, grounding subwasher 130 to earth ground. However, subwasher 130 may not be properly grounded due to issues with main grounding path 470 (e.g., bad connections, manufacturing faults). As such, control circuit 200 is configured to determine a grounding state of subwasher 130 (e.g., if subwasher 130 is properly grounded or not).

In addition to main grounding path 470, subwasher grounding circuit 300 includes test ground path 475 operatively coupling subwasher 130 to control circuit 200. As such, a test signal 410 may be applied to earth ground input 170. If subwasher 130 is properly grounded, test signal 410 will be received by control circuit 200. If the subwasher 130 is not properly grounded, test signal 410 will not be received by control circuit 200.

As shown in FIG. 4, control circuit 200 includes a ground detection circuit 400 configured to receive test signal 410 from test ground path 475 at 440. Test ground path 475 operatively couples ground detection circuit 400 to subwasher 130. Control circuit 200 further includes controller 220. Controller 220 is configured to determine a grounding state of subwasher 130 based at least in part on test signal 410 received at 440 from test ground path 475. Specifically, ground detection circuit 400 may be configured to provide a feedback signal 414 to controller 220. Feedback signal 414 is indicative of test signal 410 received at 440. In some embodiments, controller 220 may include one or more processor(s) 222 and memory 224. Processor 222 may include a microprocessor, CPU or the like, such as a general or special purpose microprocessor operable to execute programming instructions or micro-control code. Processor 222 may operate to execute processes and/or functions described within the present disclosure. For example, processor 222 may execute programming instructions or micro-control code associated with operation of an appliance such as the washing machine appliance 100 shown in FIGS. 1-3. Memory 224 represents computer readable memory that is accessible to the controller 220. Memory 224 may represent random access memory such as DRAM, or read only memory such as ROM or FLASH. Alternatively, controller 220 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

In some embodiments, controller 220 may include sensitive electrical components. As such, controller 220 may be electrically isolated from test ground path 475. For example, ground detection circuit 400 may include one or more circuit isolating components such that controller 220 is electrically isolated from test ground path 475. Accordingly, controller 220 may interface (e.g., enable, receive feedback from) test ground path 475 without a direct electrical connection.

Control circuit 200 may determine a grounding state of subwasher 130 when the washing machine appliance is in a subwasher testing mode. The subwasher testing mode may be initiated, for example, as part of testing during manufacturing of the washing machine appliance. As such, ground detection circuit 400 may be electrically connected to subwasher 130 when the washing machine appliance is in a subwasher testing mode. Furthermore, ground detection circuit 400 may be electrically disconnected from subwasher 130 when the washing machine appliance is not in the subwasher testing mode, such as during operation of the washing machine appliance. Specifically, ground detection circuit 400 may electrically connect and disconnect from subwasher 130 based on enable signal 412 provided to ground detection circuit 400 from controller 220. This provides isolation between the earth ground at the subwasher (e.g., provided by the main grounding path) and the control circuit 200 during operation of the washing machine appliance. Accordingly, test ground path 475 is separate from the main grounding path 470. For example, test ground path 475 is only in use during the subwasher testing mode, while main grounding path 470 is in use at all times (e.g., main grounding path 470 is a permanent connection).

In some embodiments, control circuit 200 may be configured to provide test signal 410 to earth ground input 170. As previously stated, test signal 410 may be an alternating current (AC) signal, such as a square wave signal. Accordingly, control circuit 200 may be configured to generate (e.g., drive) an alternating current (AC) signal, such as a square wave signal. Furthermore, control circuit 200 may provide test signal 410 to earth ground input 170 when the washing machine appliance is in a subwasher testing mode. For example, controller 220 may provide an enable signal 412 to ground detection circuit 400, electrically connecting control circuit 200 to subwasher 130 via test ground path 475. Control circuit 200 may then provide test signal 410 to earth ground input 170. Controller 220 may then determine the grounding state of the subwasher 130 based on test signal 410 (e.g., feedback signal 414 indicative of test signal 410).

As described above in reference to FIGS. 1-3, control circuit 200 may be positioned within control panel 150 of a washing machine appliance. Accordingly, the grounding state of subwasher 130 may be determined from control panel 150 of the washing machine appliance without the use of additional external hardware (e.g., troubleshooting hardware, diagnostics equipment). For example, control circuit 200 may determine the grounding state of subwasher 130 and provide the grounding state of subwasher 130 to an output device of control panel 150, such as display 154 (FIGS. 1-2).

Figure 5:
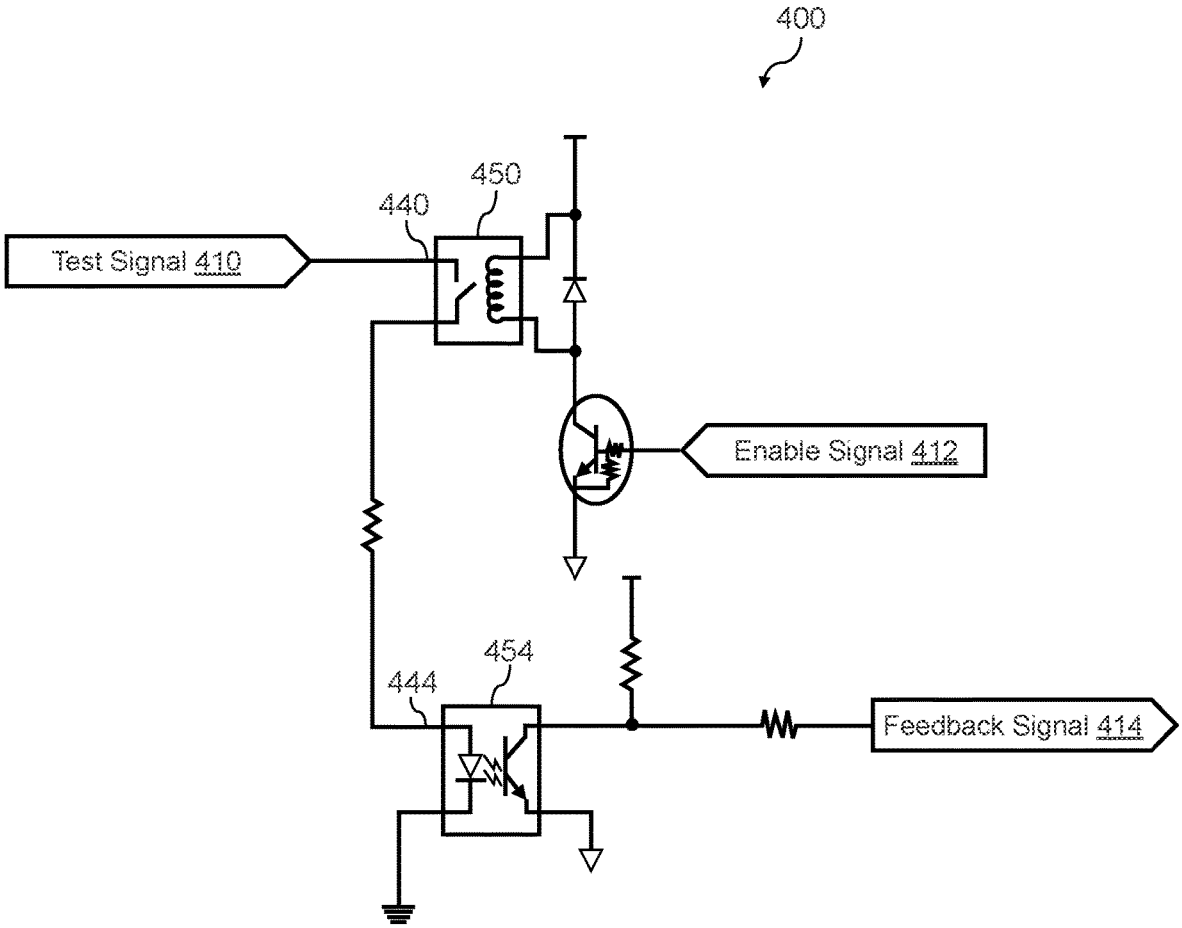
FIG. 5 depicts an example circuit schematic of a ground detection circuit according to example embodiments of the present disclosure.

Referring now to FIG. 5, an example circuit schematic of a ground detection circuit according to example embodiments of the present disclosure is depicted.

Ground detection circuit 400 is configured to receive a test signal 410 at 440. The test signal 410 may be an alternating current (AC) signal, such as a square wave signal. As previously described, test signal 410 is received from test ground path 475 as shown in FIG. 4. Ground detection circuit 400 is further configured to provide a feedback signal 414 indicative of test signal 410 to controller 220 (FIG. 4).

Ground detection circuit 400 may include switching component 450 (e.g., switching component, relay switch) configured to electrically connect and disconnect ground detection circuit 400 from subwasher 130 (FIG. 4). Accordingly, test signal 410 may only be received when ground detection circuit 400 is electrically connected to subwasher 130 (FIG. 4). This provides isolation between the earth ground at the subwasher (e.g., provided by the main grounding path) and the controller 220 (FIG. 4), for example, during operation of the washing machine appliance.

Ground detection circuit 400 further includes sensing component 454 (e.g., opto-coupler) configured to generate feedback signal 414 based on a test signal 410 received at 444. In some embodiments, switching component 450 and sensing component 454 may be circuit isolating components configured to electrically isolate controller 220 from test ground path 475. For example, switching component 450 may be a relay switch and sensing component 454 may be an opto-coupler (e.g., optoisolator).

As previously described, control circuit 200 may determine a grounding state of subwasher 130 when the washing machine appliance is in a subwasher testing mode. Accordingly, controller 220 (FIG. 4) may provide an enable signal 412 to ground detection circuit 400 when the washing machine appliance is in the subwasher testing mode. Enable signal 412 is configured to control (e.g., open/close) switching component 450. Switching component 450 may electrically connect and disconnect ground detection circuit 400 from subwasher 130 (FIG. 4) based on enable signal 412. When enable signal 412 is provided, switching component 450 may close, electrically connecting sensing component 454 to earth ground input 170 (FIG. 4). Test signal 410 may then be provided to earth ground input 170 (FIG. 4). If test signal 410 is received at 444, sensing component 454 will provide feedback signal 414 indicative of test signal 410.

Figure 6:
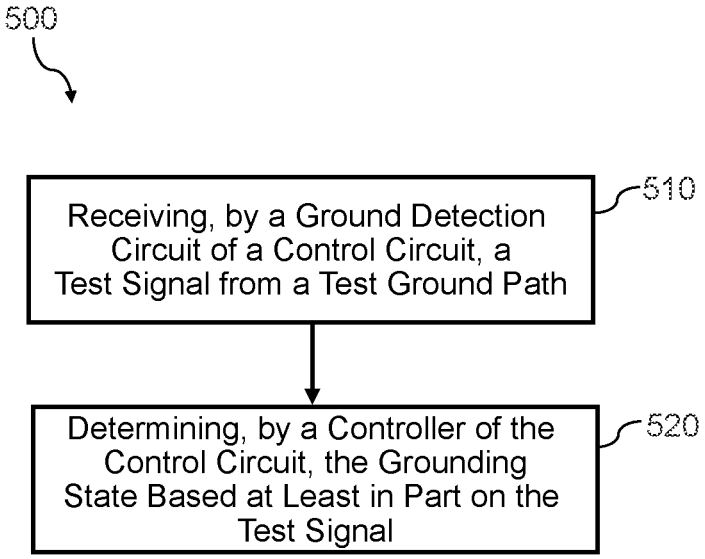
FIG. 6 depicts an example method for determining a grounding state of a subwasher in a washing machine appliance according to example embodiments of the present disclosure.

Referring now to FIG. 6, a method 500 for determining a grounding state of a subwasher in a washing machine appliance is provided. Those of ordinary skill in the art, using the disclosures provided herein, will understand that various steps of any of the methods described herein can be omitted, expanded, performed simultaneously, rearranged, and/or modified in various ways without deviating from the scope of the present disclosure. Furthermore, various steps (not illustrated) can be performed without deviating from the scope of the present disclosure. Additionally, method 500 may be performed by control circuit 200 as depicted in FIGS. 1-4. While method 500 is generally described with reference to control circuit 200 (e.g., controller 220 of control circuit 200), those of ordinary skill in the art will understand that method 500 can be implemented by any suitable control circuit for a washing machine appliance. For example, method 500 can be implemented by a control circuit in any washing machine appliance.

At 510, method 500 includes receiving, by a ground detection circuit of a control circuit, a test signal from a test ground path. For example, ground detection circuit 400 of control circuit 200 may receive test signal 410 from test ground path 475.

At 520, method 500 includes determining, by a controller of the control circuit, the grounding state based at least in part on the test signal. For example, controller 220 of control circuit 200 may determine the grounding state (e.g., if subwasher 130 is grounded or not) based on feedback signal 414 which is indicative of test signal 410 received by sensing component 454 of ground detection circuit 400.

One example aspect of the present disclosure is directed to a control circuit for a washing machine appliance. The control circuit includes a ground detection circuit configured to receive a test signal from a test ground path. The control circuit further includes a controller configured to determine a grounding state of a subwasher of the washing machine appliance based at least in part on the test signal. The test ground path operatively couples the ground detection circuit to the subwasher.

In some examples, the test signal is a square wave signal.

In some examples, the controller is electrically isolated from the test ground path.

In some examples, the ground detection circuit is electrically connected to the subwasher when the washing machine appliance is in a subwasher testing mode.

In some examples, the ground detection circuit is electrically disconnected from the subwasher when the washing machine appliance is not in the subwasher testing mode.

In some examples, the test signal is provided at an earth ground input of the washing machine appliance.

In some examples, the test signal is provided at the earth ground input of the washing machine appliance by the control circuit.

In some examples, the test ground path is separate from a main grounding path of the washing machine appliance.

In some examples, the washing machine appliance is a top loading washing machine appliance.

Another example aspect of the present disclosure is directed to a method for determining a grounding state of a subwasher in a washing machine appliance. The method includes receiving, by a ground detection circuit of a control circuit, a test signal from a test ground path. The method further includes determining, by a controller of the control circuit, the grounding state based at least in part on the test signal. The test ground path operatively couples the ground detection circuit to the subwasher.

In some examples, the test signal is a square wave signal.

In some examples, the controller is electrically isolated from the test ground path.

In some examples, the ground detection circuit is electrically connected to the subwasher when the washing machine appliance is in a subwasher testing mode.

In some examples, the ground detection circuit is electrically disconnected from the subwasher when the washing machine appliance is not in the subwasher testing mode.

In some examples, the test ground path is separate from a main grounding path of the washing machine appliance.

In some examples, the washing machine appliance is a top loading washing machine appliance.

Another example aspect of the present disclosure is directed to a washing machine appliance. The washing machine appliance includes a subwasher. The washing machine appliance further includes a control circuit. The control circuit includes a ground detection circuit configured to receive a test signal from a test ground path. The control circuit further includes a controller configured to determine a grounding state of a subwasher of the washing machine appliance based at least in part on the test signal. The test ground path operatively couples the ground detection circuit to the subwasher.

In some examples, the subwasher includes a wash tub, a wash basket, and a motor assembly.

In some examples, the test signal is a square wave signal.

In some examples, the controller is electrically isolated from the test ground path.

While the present subject matter has been described in detail with respect to specific example embodiments thereof, it will be appreciated that those skilled in the art, upon attaining an understanding of the foregoing can readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A control circuit for a washing machine appliance, comprising:

a ground detection circuit configured to receive a test signal from a main ground path via a test ground path; and a controller configured to determine a grounding state of a subwasher of the washing machine appliance based at least in part on the test signal; and wherein the test ground path operatively couples the ground detection circuit to the subwasher.

2. The control circuit of claim 1, wherein the test signal is a square wave signal.

3. The control circuit of claim 1, wherein the controller is electrically isolated from the test ground path.

4. The control circuit of claim 1, wherein the ground detection circuit is electrically connected to the subwasher when the washing machine appliance is in a subwasher testing mode.

5. The control circuit of claim 4, wherein the ground detection circuit is electrically disconnected from the subwasher when the washing machine appliance is not in the subwasher testing mode.

6. The control circuit of claim 1, wherein the test signal is provided at an earth ground input of the washing machine appliance.

7. The control circuit of claim 6, wherein the test signal is provided at the earth ground input of the washing machine appliance by the control circuit.

8. The control circuit of claim 1, wherein the test ground path is separate from the main ground path of the washing machine appliance.

9. The control circuit of claim 1, wherein the washing machine appliance is a top loading washing machine appliance.

10. A method for determining a grounding state of a subwasher, disposed between a main ground path and a test ground path, in a washing machine appliance, the method comprising:

receiving, by a ground detection circuit of a control circuit, a test signal from the test ground path; and determining, by a controller of the control circuit, the grounding state based at least in part on the test signal, wherein the test ground path operatively couples the ground detection circuit to the subwasher.

11. The method of claim 10, wherein the test signal is a square wave signal.

12. The method of claim 10, wherein the controller is electrically isolated from the test ground path.

13. The method of claim 10, wherein the ground detection circuit is electrically connected to the subwasher when the washing machine appliance is in a subwasher testing mode.

14. The method of claim 13, wherein the ground detection circuit is electrically disconnected from the subwasher when the washing machine appliance is not in the subwasher testing mode.

15. The method of claim 10, wherein the test ground path is separate from the main ground path of the washing machine appliance.

16. The method of claim 10, wherein the washing machine appliance is a top loading washing machine appliance.

17. A washing machine appliance, comprising:

a subwasher;

control circuit, comprising:

a ground detection circuit configured to receive a test signal from a main ground path via a test ground path; and a controller configured to determine a grounding state of the subwasher of the washing machine appliance based at least in part on the test signal; and wherein the test ground path operatively couples the ground detection circuit to the subwasher permanently coupled with the main ground path.

18. The washing machine appliance of claim 17, wherein the subwasher comprises:

a wash tub;

a wash basket; and a motor assembly.

19. The washing machine appliance of claim 17, wherein the test signal is a square wave signal.

20. The washing machine appliance of claim 17, wherein the controller is electrically isolated from the test ground path.

* * * * *